US009599039B2

(12) United States Patent
Odillard et al.

(10) Patent No.: US 9,599,039 B2
(45) Date of Patent: Mar. 21, 2017

(54) CONTROL DEVICE FOR A FLOW OF INTAKE GAS AND/OR RECIRCULATED EXHAUST GASES IN A CYLINDER OF AN INTERNAL COMBUSTION ENGINE AND CORRESPONDING INTAKE MODULE

(71) Applicant: Valeo Systemes Thermiques, Le Mesnil Saint Denis (FR)

(72) Inventors: Laurent Odillard, Le Luart (FR); Julio Guerra, Itteville (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 176 days.

(21) Appl. No.: 14/559,517

(22) Filed: Dec. 3, 2014

(65) Prior Publication Data

US 2015/0152797 A1 Jun. 4, 2015

(30) Foreign Application Priority Data

Dec. 3, 2013 (FR) ..... 13 62006

(51) Int. Cl.

| | |
|---|---|
| ***F02D 17/02*** | (2006.01) |
| *F02D 19/12* | (2006.01) |
| *F02M 35/10* | (2006.01) |

(52) U.S. Cl.

CPC ..... *F02D 17/02* (2013.01); *F02M 26/21* (2016.02); *F02D 19/12* (2013.01); *F02M 26/43* (2016.02); *F02M 26/71* (2016.02); *F02M 35/10222* (2013.01)

(58) Field of Classification Search

CPC ..... F02D 17/02; F02D 19/12; F02M 26/21; F02M 26/71; F02M 26/57; F02M 26/43; F02M 26/49; F02M 35/10; F02M 35/10222

See application file for complete search history.

(56) References Cited

U.S. PATENT DOCUMENTS

| | | | | |
|---|---|---|---|---|
| 4,130,094 A * | 12/1978 | Gropp | F02M 26/57 | 123/568.27 |
| 5,621,167 A * | 4/1997 | Fang-Cheng | F02M 26/49 | 123/568.16 |
| 8,261,725 B2 * | 9/2012 | Furukawa | F16K 35/14 | 123/568.17 |

* cited by examiner

*Primary Examiner* — Hieu T Vo

(74) *Attorney, Agent, or Firm* — Howard & Howard Attorneys PLLC

(57) ABSTRACT

A control device for a flow of intake gas and/or recirculated exhaust gases in a cylinder of an internal combustion engine, and for an intake module comprising at least one pipe which is arranged so as to supply the cylinder is disclosed. The control device comprises a means for sealing, and a means for deactivating at least one pipe which is able to be controlled between a first position in which the pipe supplies the cylinder with the intake gases (F) and a second position in which the pipe supplies the cylinder with the recirculated exhaust gases. The means for sealing is configured so as to be displaced as a result of the difference in pressure between the intake and the exhaust on both sides of the means for sealing between a locked position of the means for deactivating in the first position, and a position of release of the means for deactivating.

13 Claims, 4 Drawing Sheets

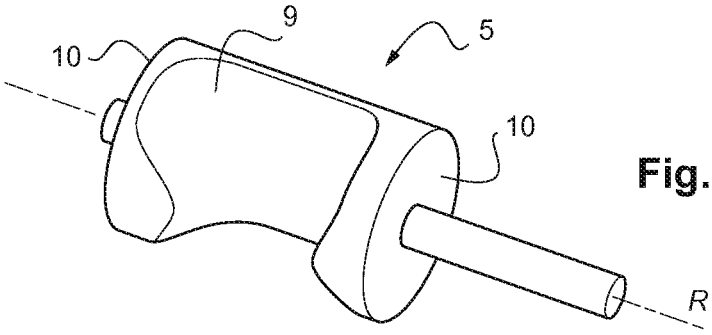
Fig.7
Fig.8
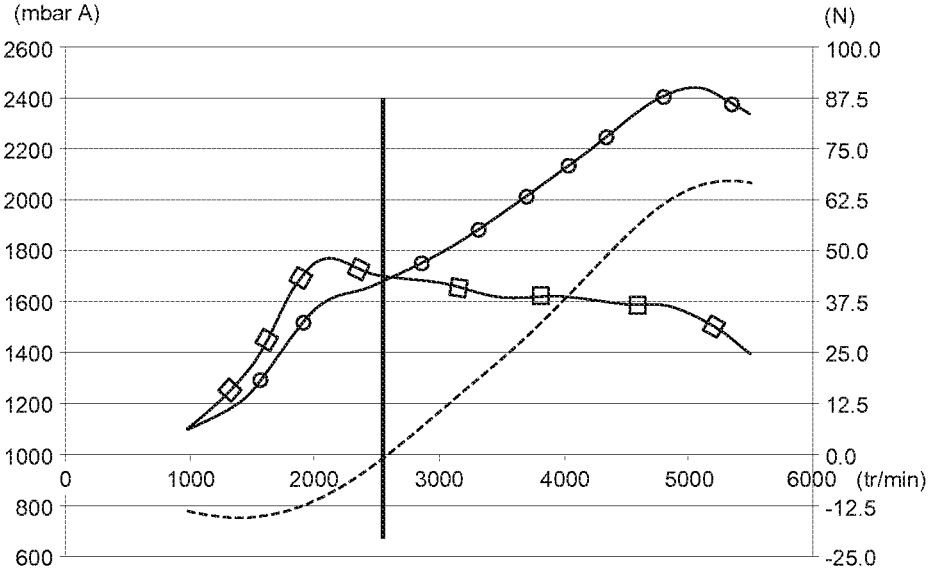

CONTROL DEVICE FOR A FLOW OF INTAKE GAS AND/OR RECIRCULATED EXHAUST GASES IN A CYLINDER OF AN INTERNAL COMBUSTION ENGINE AND CORRESPONDING INTAKE MODULE

RELATED APPLICATIONS

This application claims priority to and all the advantages of French Patent Application No. FR 13/62006, filed on Dec. 3, 2013, the content of which is incorporated herein by reference.

The invention relates to the field of the supply of air to internal combustion engines. The invention relates more particularly to multi-cylinder engines and devices used to control the flows of intake gas and recirculated exhaust gases to the cylinders.

BACKGROUND

The engines under discussion may be of the spark ignition type or compression ignition type (Diesel engine). The engines may be turbocharged or charged with air at atmospheric pressure.

Hereinafter, "intake gas" will be understood as fresh air. Moreover, the term "exhaust gas" will be used specifically to denote the gases resulting from a combustion process between a fuel and the air supplied to the engine, recovered at the engine outlet, according to a method generally known by the English acronym EGR (Exhaust Gas Recirculation). Usually, an engine operates by using all of its cylinders according to a known four-stroke cycle: admission—compression—combustion/expansion—exhaust. This cycle is characterized by its efficiency which is recognized as being optimal when the losses due to the transfer of the gases, also called losses due to surging, during the intake and exhaust phases, are minimal.

In order to limit these losses, it has been proposed to deactivate one or more cylinders during operation at low load or more generally when the power required may be provided only by a portion of the cylinders of the engine.

The deactivation is generally carried out by acting directly on the opening of the valves of the relevant cylinders by making them either completely inactive or controlling the valves differently from one another.

However, as no air is supplied to the deactivated cylinder this causes drawbacks. In particular, the temperature in the deactivated cylinder reduces significantly which lowers the overall temperature of the exhaust gases, in particular when restarting the cylinder. Even without the passage of fresh air, this reduction in temperature is harmful to the catalytic converter in the system for treating the exhaust gases.

One solution consists in supplying the deactivated cylinder(s) with exhaust gases recovered at the engine outlet. In particular, as said gases are hot and are able to be returned to high pressure, this makes it possible to maintain the temperature and the pressure in the deactivated cylinder.

The implementation of this device generally requires a means of controlling the flow in at least one of the pipes of the intake manifold making it possible to block the passage of the recirculated exhaust gases or to block the passage of the intake gases, and also a device permitting the communication between an exhaust gas manifold and the volume between the first means and an intake valve for the intake gases.

A hermetic sealing means at the inlet of the recirculated exhaust gases is essential in this case in order to guarantee the seal between the exhaust gas manifold and the intake manifold when the deactivation of a cylinder is inactive, i.e. the cylinder has to be supplied solely with intake gas.

However, the control system for these two means for controlling the flow and the hermetic sealing of the inlet of recirculated exhaust gases, may prove complex, heavy, bulky and expensive. More specifically, two control systems, in particular two mechanical systems which may be independent of one another, are required to control the means for controlling the flow and the means for hermetic sealing of the inlet of recirculated exhaust gases.

SUMMARY OF THE INVENTION

The object of the invention is to remedy these drawbacks of the prior art by proposing a control device for the flows of intake gas and/or exhaust gas, the control thereof being simplified.

To this end, the subject of the invention is a control device for a flow of intake gas and/or recirculated exhaust gases in an internal combustion engine cylinder, for an intake module comprising at least one pipe which is arranged so as to supply the cylinder with intake gas and/or recirculated exhaust gases, said device comprising:

- a means for deactivating at least one pipe which is able to be controlled between a first position in which the pipe supplies the cylinder with the intake gases and a second position in which the pipe supplies the cylinder with the recirculated exhaust gases, and
- a sealing means capable of closing hermetically an opening of the pipe for the inlet of exhaust gases, characterized in that the sealing means is configured so as to be displaced as a result of the difference in pressure between the intake and exhaust on both sides of the sealing means, between:

- a locked position of the deactivation means in the first position when the pressure at the exhaust is higher than the pressure at the intake, and
- a position of release of the deactivation means when the pressure at the exhaust is lower than the intake pressure.

Using such a sealing means which is controlled by the pressures at the intake and exhaust, the control of the hermetic sealing means of the inlet of recirculated exhaust gases according to the prior art is dispensed with. The seal between the gases of the exhaust manifold and the gases of the intake manifold is implemented by an automatic sealing means which is moved as a result of the difference in pressure between the intake and exhaust.

According to one feature of the invention, the sealing means comprises at least one piston.

According to one embodiment, the deactivation means comprises a member which is rotatable about an axis and capable of being arranged in a pipe of the intake module such that the axis is arranged substantially transversely relative to the pipe.

The piston is advantageously configured so as to be displaced in translation along an axis substantially perpendicular to the axis of rotation of the deactivation means.

According to one particular embodiment, the piston has a flattened portion on at least one surface. This flattened portion permits the piston to be pressurized to the pressure at the intake.

According to a further feature of the invention, the sealing means is configured so as to be in contact with the deactivation means in the locked position and has a shape which is complementary to the shape of the deactivation means in the region of the contact area.

According to one embodiment, the deactivation means comprises a rotating plug valve of substantially cylindrical overall shape, comprising a lateral flank which is shaped so as to permit or block the circulation of intake gases and/or recirculated exhaust gases as a function of the angular position of the rotating plug valve.

The lateral flank is shaped, for example, so as to block the opening when the plug valve is in the first position and to block the passage cross section of the intake gases from the intake manifold when the plug valve is in the second position.

The device may comprise at least one return means which is arranged so as to urge the sealing means into the position of release of the deactivation means.

This return means may be a spring, such as a compression spring. The sealing means is thus controlled by the pressures at the intake and exhaust of the engine, whilst being subjected to the force of the spring.

Thus, the sealing means is pushed into the position of release of the sealing means, i.e. toward the intake of the exhaust gases as a result of the difference in the intake/exhaust pressure and under the action of the compression spring.

When the pressure at the exhaust is higher than the pressure at the intake and the force of the compression spring, the sealing means is pushed against the deactivation means, into the locked position of the deactivation means.

Moreover, the spring makes it possible to modify the engine speed limit for locking the deactivation means.

According to one embodiment, the device comprises a closure cap which is arranged opposite the sealing means, which is shaped so as to permit the inlet of exhaust gases and which has at least one means for pressurizing to the pressure at the exhaust, such as an orifice permitting the passage of exhaust gases.

The invention also relates to an air intake module for an internal combustion engine, comprising at least one control device as defined above.

According to one embodiment, the intake module is configured for an internal combustion engine comprising at least two cylinders, said module comprising at least two control devices as defined above, each of said devices being arranged so as to supply one of said cylinders and the two devices being controlled independently of one another.

Thus it is possible to deactivate a single cylinder and to control the flow of intake gas or exhaust gas in the associated pipe independently of the control of the flow in the pipe associated with the other cylinder.

Naturally, it is also possible to deactivate the two cylinders.

BRIEF DESCRIPTION OF DRAWINGS

Further features and advantages of the invention will appear more clearly from reading the following description given by way of illustrative and non-limiting example and with reference to the accompanying drawings, in which:

FIG. 7 is a view of a plug valve of the sealing device, and FIG. 8 is a graph showing the evolution of the pressure at the intake, the pressure at the exhaust and the force of the sealing means against the deactivation means of a pipe as a function of the engine speed.

DETAILED DESCRIPTION

Figure 1:
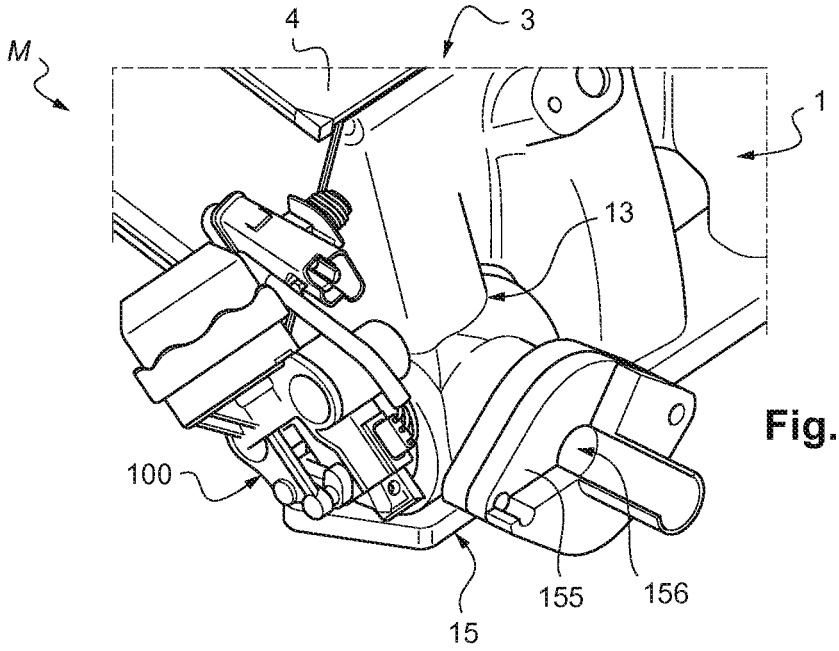
FIG. 1 is a perspective view of an air intake module equipped with a control device for the flow of intake gases and/or recirculated exhaust gases according to the invention.

In these figures, elements which are substantially identical bear the same reference numerals.

The invention relates to an intake module M partially visible in FIG. 1, which is designed to be placed on the cylinder head of an engine and which comprises, for each cylinder of a multi-cylinder engine, at least one pipe 1 designed to be extended in the cylinder head to supply the cylinder with intake gas.

Moreover, the intake module M comprises an intake manifold 3 into which the pipe(s) 1 discharge. The intake manifold 3 is supplied with intake gas by a system, not shown in the figures. The intake manifold 3 may have an overall shape of a substantially parallelepipedal container.

As the engine has multiple cylinders, the intake manifold 3 is configured to redistribute the flows of intake gas between the pipes 1 respectively associated with a cylinder of the engine according to the illustrated example.

The intake manifold 3 may comprise a heat exchanger 4 traversed by the intake gases before being distributed into the supply pipes of the different cylinders. The heat exchanger 4 is configured to cool the charge air. Such a heat exchanger 4 is generally called a charge air cooler "CAC".

The heat exchanger 4 may be integrated in the intake manifold 3 or may be offset, as a variant.

Moreover, the volume of the intake manifold 3 may be placed in fluidic communication with an exhaust manifold (not shown in the figures) so as to permit a recirculation of the exhaust gases recovered at the outlet of the engine in one or more cylinders to be deactivated, in particular during operation at low load or when the power demanded may be provided merely by a portion of the cylinders. More specifically, when the engine speed is low, the deactivation of a cylinder makes it possible to reduce losses as a result of surging.

To achieve this an opening 13, for example, is provided in at least one pipe 1, permitting a connection to a manifold for recovered exhaust gases at the outlet of the engine (not shown in the figures).

To this end, the intake module M comprises a control device 100 for the flow of intake gases and/or recirculated exhaust gases. The control device 100 makes it possible to control the circulation of a flow of intake gas in a cylinder or the circulation of exhaust gas in a cylinder to be deactivated.

The control device 100 may be arranged on the intake module M in the region of at least one associated pipe 1.

In order to be able to deactivate a plurality of cylinders of the engine, a control device 100 may also be provided for the deactivation of at least two pipes 1 side by side.

As an alternative, it may be possible to provide a control device 100 associated with a single pipe 1; in the case of a plurality of control devices 100, they are independent relative to one another. In other words, each intake pipe is equipped with a specific control device 100 having a control means independent of the other control devices 100.

Figure 2:
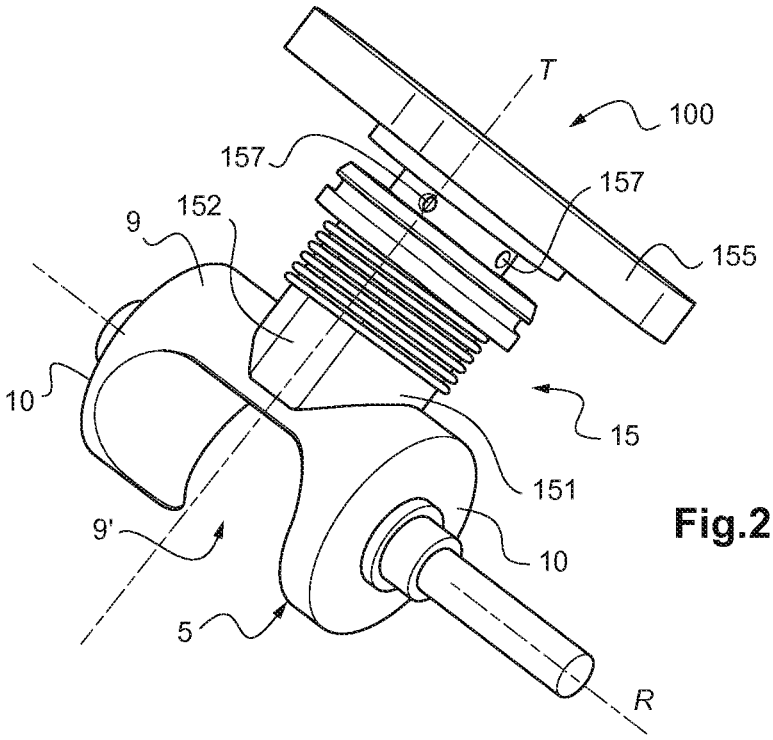
FIG. 2 shows a means for deactivating an associated pipe and an associated sealing means of the control device.

Moreover, as illustrated in FIG. 2, a control device 100 comprises:

- on the one hand, a deactivation means 5 for one or more pipes 1, and
- on the other hand, a sealing means 15 capable of locking or releasing/unlocking the deactivation means 5.

Figure 3A:
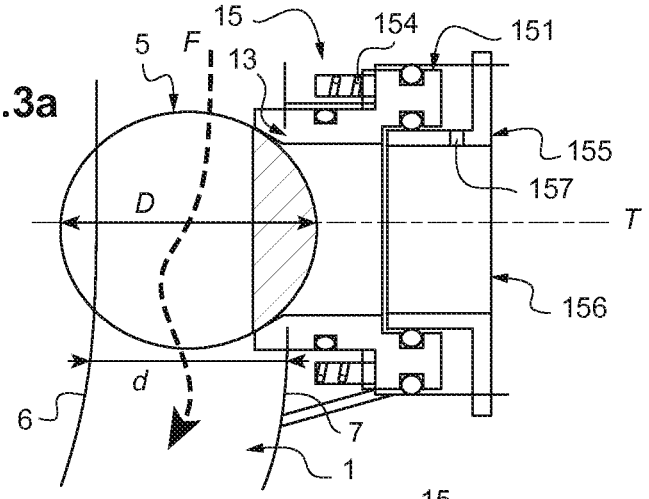
FIG. 3*a* is a schematic sectional view of the deactivation means of a pipe in a first position in the locked state.
Figure 3B:
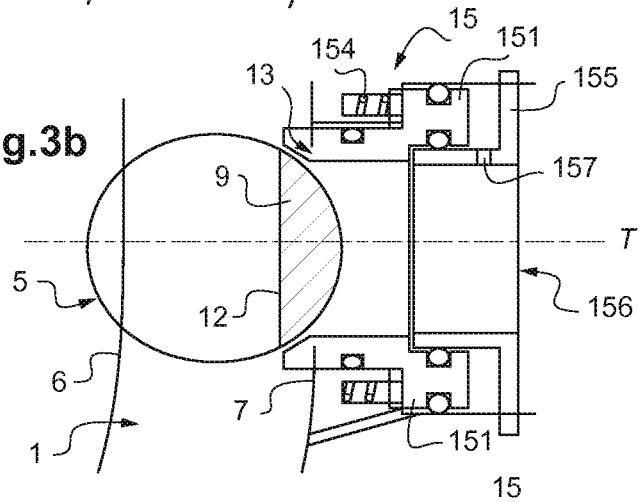
FIG. 3*b* is a schematic sectional view of the deactivation means of a pipe in the first position in the unlocked state, FIG. 4 repeats FIG. 3*a* in a second position of the deactivation means.
Figure 4:
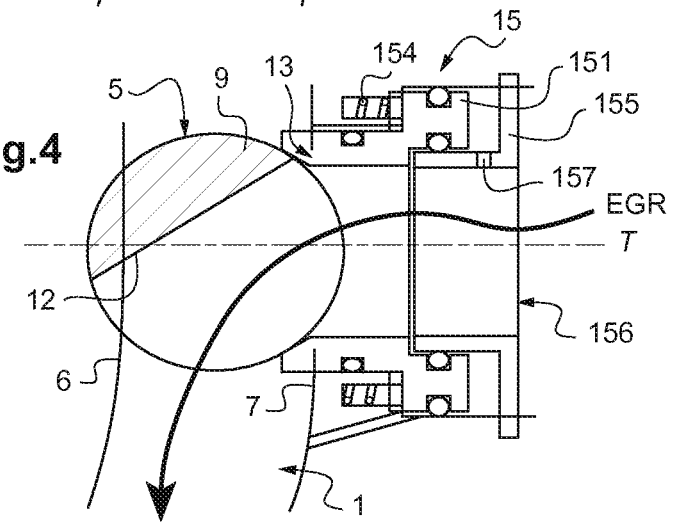

The deactivation means 5 is controllable between:

- a first position, also called the active position shown schematically in FIGS. 3*a* and 3*b*, permitting the circulation of intake gas, i.e. fresh air in a pipe 1, the fresh air being shown by the arrow F in FIG. 3*a*, and
- a second position, also called the deactivation position, shown schematically in FIG. 4, blocking the circulation of intake gases in the pipe 1 and permitting the circulation of exhaust gas in this pipe 1, the exhaust gases being shown by the arrow EGR.

The control device 100 advantageously comprises a mechanical system only controlling the movement of the deactivation means 5.

Figure 6:
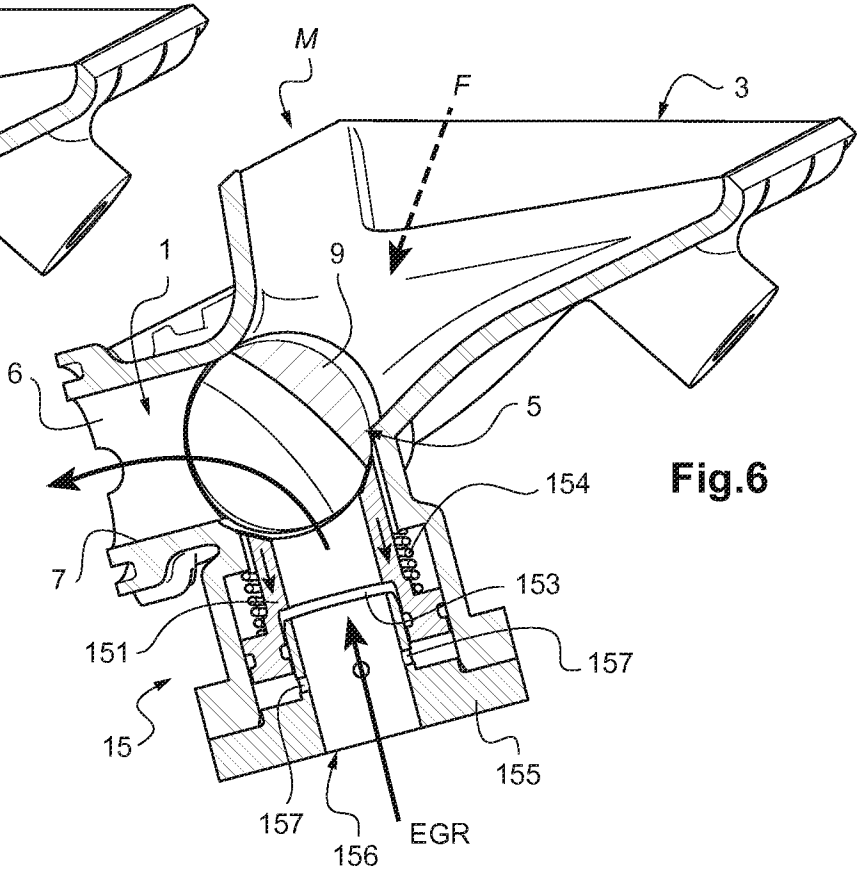
FIG. 6 is a sectional view of the intake module with the deactivation means in the second position blocking the intake gases in the pipe equipped with the device and allowing the exhaust gases to pass.
Figure 5:
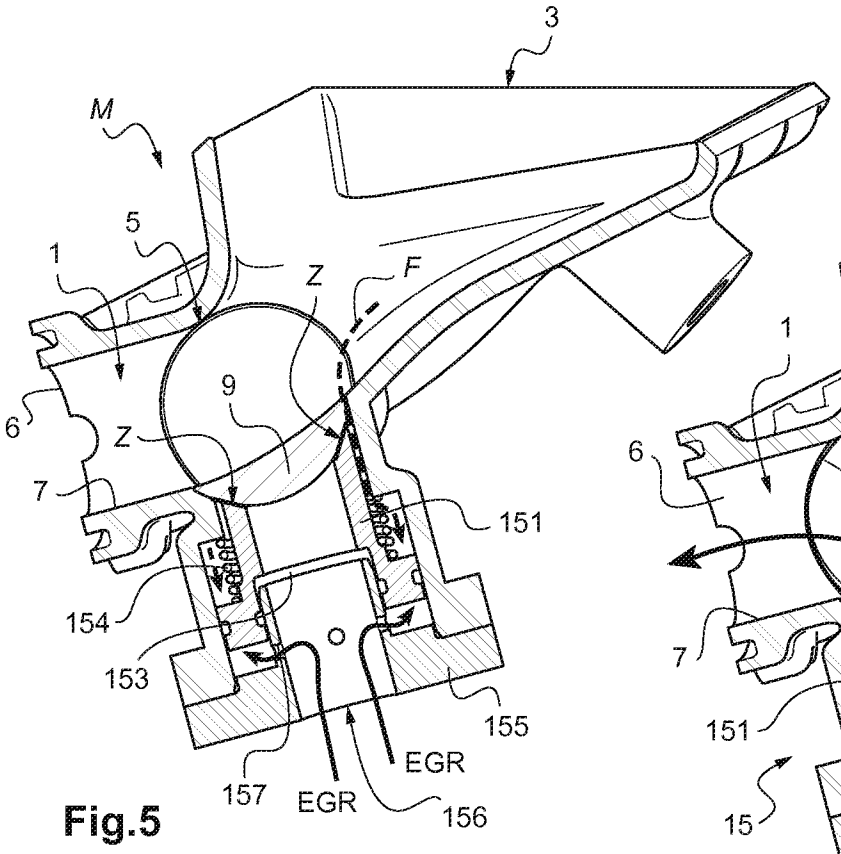
FIG. 5 is a sectional view of the intake module with the deactivation means in the first position allowing the intake gases to pass into the pipe equipped with the device and blocking the inlet of exhaust gases.

The deactivation means 5 is, for example, implemented in the form of a rotating member, such as a shutter or plug valve, arranged at the outlet of a pipe 1 in the intake manifold 3 as visible in FIGS. 5 and 6.

According to the illustrated example, the deactivation means comprises a rotating plug valve 5, most clearly visible in FIGS. 2 and 7.

According to the illustrated embodiment, the plug valve 5 has an overall shape which is substantially cylindrical and has a longitudinal axis R. The plug valve 5 is configured so as to rotate about the axis R thereof.

The plug valve 5 is capable of being arranged in the pipe 1 such that its axis R is arranged substantially transversely relative to the pipe 1. According to the example illustrated in FIGS. 3*a* to 6, the internal shape of the pipe 1 is delimited by two walls 6 and 7 opposite one another, and the plug valve 5 extends longitudinally along the axis R in a manner which is substantially parallel to the two walls 6 and 7.

Moreover, the plug valve 5 has a diameter D which is greater than the distance d between the two walls 6, 7.

According to the example illustrated in FIGS. 2 and 7, the plug valve 5 has in this case:

- a lateral flank 9 which forms a transverse part relative to the pipe 1, extending along the axis R, and
- a flow path 9' which is, for example, cut into the cylinder.

The plug valve 5 may also comprise two cups 10 of substantially circular shape, connected to the ends of the transverse part 9.

The lateral flank or transverse part 9 is capable of extending substantially parallel to the planar walls 6 and 7 when the plug valve 5 is arranged in the pipe 1.

The transverse part is shaped so as to permit or block the circulation of intake gases F and/or recirculated exhaust gases EGR, as a function of the angular position of the plug valve 5.

In other words, the transverse part 9 is shaped:

- so as to seal the opening 13 for the inlet of exhaust gases when the plug valve 5 is in the first position, thus permitting the circulation of intake gases via the flow path 9', and
- so as to seal the passage cross section for the intake gases from the intake manifold 3 when the plug valve 5 is in the second position, thus permitting the circulation of exhaust gases via the flow path 9'.

Moreover, the transverse part 9 has an internal face 12 designed to be oriented toward the interior of the pipe 1 when the plug valve 5 is arranged in the pipe 1. This internal face 12 is capable, for example, of forming a deflector for the exhaust gases when the plug valve 5 is in the second position.

Thus shaped, the plug valve 5 ensures the function of controlling the flow, allowing the intake gas to pass into the first position and blocking it in the second position.

In FIGS. 3*a*, 3*b* and 5, the plug valve 5 is in the first position leaving completely free the passage into the pipe 1 of the flow of intake gas in order to supply the cylinder located therebelow (relative to the orientation of FIGS. 3*a* and 3*b*). When the plug valve 5 is in the first position, the transverse part 9 obstructs the opening 13 produced in the pipe 1 for the connection to the exhaust gases.

In FIGS. 4 and 6, the plug valve 5 has been rotated by a predefined angle of rotation about the axis R so as to be located in the second position, in which the transverse part 9 seals the section of the pipe 1 in fluidic communication with the intake manifold 3. This result is obtained due to the plug valve 5 having a sufficient diameter D, which is greater than the distance d between the planar walls 6 and 7 as cited above. When the plug valve 5 is in the second position, the opening 13 made in the pipe 1 for the connection to the exhaust gases is completely opened up.

As a result, when the plug valve 5 is in the first position, it blocks the introduction of exhaust gas into the pipe 1 leading to the cylinder of the engine and when it is in the second position it allows the flow of exhaust gas to pass, thus permitting the recirculation of exhaust gases to supply the cylinder to be deactivated.

The plug valve 5 makes it possible to adjust the supply of the cylinder via the pipe 1 between two extreme situations, a supply solely consisting of fresh air as the supply gas and a supply solely consisting of recirculated exhaust gases.

The integration of this plug valve 5 in an associated pipe 1 of the supply module M does not influence the supply to the other cylinders. More specifically, the plug valve 5 allows the intake gases to be distributed freely to the other pipes 1 of the cylinder of the engine, the outlet thereof not being blocked.

The sealing means in turn 15 is configured so as to be displaced as a result of the difference in pressure between the intake and the exhaust on both sides of the sealing means 15, between:

- a locked position of the plug valve 5 in the first position, and
- a position of release or an unlocked position of the plug valve 5.

According to the illustrated embodiment, the sealing means 15 is arranged in front of the opening 13 supplying the exhaust gases opposite the plug valve 5, in order to be able to close hermetically this exhaust gas inlet. The sealing means 15 is capable of controlling the fluidic communication between the opening 13 in the supply pipe 1 to the cylinder and an exhaust gas manifold (not shown).

As a result of the difference in pressure between the intake and exhaust, during normal operation, i.e. when a cylinder has not been deactivated, the sealing means 15 permits a hermetic seal of the opening 13 of the pipe 1 preventing any fluidic communication between the intake gases and the exhaust gases, by locking the deactivation means 5 in the first position.

More specifically, when the speed and the load of the engine increase, all of the cylinders are activated. It is thus essential to achieve a perfect seal between the intake gases and the exhaust gases EGR.

The movement of the sealing means 15 to lock or release the deactivation means 5 is controlled by the difference in pressure between the intake and exhaust acting thereon on both sides.

To this end, the sealing means 15 comprises at least one piston 151 arranged opposite the opening 13 of the pipe 1 permitting the connection to the exhaust gases. Thus arranged, the piston 151 is thus subjected, on the one hand, to the pressure at the intake and, on the other hand, to the pressure at the exhaust.

The piston 151 may be shaped so as to permit the passage of intake gases over one surface of the piston 151, for example by producing a flattened portion 152 over a surface of the piston 151, which is visible in FIG. 2. This permits the piston to be pressurized to the intake pressure.

Preferably, the piston 151 is arranged so as to be displaced in translation along an axis T substantially perpendicular to the axis of rotation R of the plug valve 5 (see FIG. 2). A stop 153, visible in the FIGS. 5 and 6, advantageously permits the displacement of the piston 151 to be limited when said piston is not in contact with the plug valve 5.

So as to lock the plug valve 5 and ensure the seal, the piston 151 has a shape which is complementary to the shape of the plug valve 5 in the region of its common contact area with the plug valve 5. The piston 151 is configured so as:

- to close hermetically the opening 13 permitting the intake of exhaust gases (see FIG. 3*a*) by locking the plug valve 5 when the pressure at the exhaust is higher than the pressure at the intake, and
- to release the plug valve 5 (see FIG. 3*b*) when the pressure at the intake is higher than the pressure at the exhaust so that the plug valve 5 may rotate freely.

Thus, when the engine speed is low, the pressure at the intake is generally higher than the pressure at the exhaust, the piston 151 is pushed toward the inlet of the exhaust gases EGR as a result of the difference in intake/exhaust pressure. The plug valve 5 is thus unlocked (see FIG. 6) as a result of the spacing of the piston 151 which is not in sealed contact with the plug valve 5. The plug valve 5 may rotate freely for the activation (first position visible in FIG. 3*a*) or the deactivation (second position visible in FIG. 4) of one or more cylinders.

When the speed and load of the engine increase, all of the cylinders are activated. The pressure at the exhaust naturally becomes higher than the pressure at the intake. The piston is thus pushed against the plug valve 5: the contact between the piston 151 and the plug valve 5 thus produces the seal of the assembly. The contact areas Z between the plug valve 5 and the piston 151 ensuring the seal between the intake gases and the exhaust gases are shown schematically in FIG. 5.

If, when the pressure at the exhaust is higher than the pressure at the intake, the cylinder associated with the pipe 1 is deactivated, the plug valve 5 remains free.

In FIG. 8 has been shown:

- a curve of the evolution of the pressure at the intake in mbarA as a function of the engine speed in r/min, this curve being identified by squares,
- a curve of the evolution of the pressure at the exhaust in mbarA as a function of the engine speed in r/min, this curve being identified by circles, and
- a curve of the evolution of the force of the piston 151 against the plug valve 5 in N as a function of the engine speed in r/min, this curve being shown in dashed lines.

As mentioned above, when the engine speed is low, in this case less than for example 2500 r/min, the pressure at the intake is higher than the pressure at the exhaust. The point of intersection between the pressure at the intake and the pressure at the exhaust, i.e. before the inversion of the curves such that the pressure at the exhaust becomes higher than the pressure at the intake, is in the region of 2500 r/min according to the illustrated example.

This point of intersection corresponds to the engine speed from which there is the option to lock the plug valve 5 using the piston 151 in order to guarantee the seal between the intake gases and the exhaust gases when the cylinder has to be supplied solely with intake gas.

With reference again to FIGS. 5 and 6, it is possible to provide at least one return means 154, such as a spring 154, for example working under compression, which makes it possible to offset the locking point of the plug valve 5 corresponding to the point of intersection between the pressures at the intake and exhaust, by modifying the calibration of the spring 154.

The piston 151 is thus controlled by pressures at the intake and at the exhaust of the engine, whilst being subjected to the force of the compression spring 154.

Thus, when the engine speed is low, the piston 151 is then pushed toward the exhaust gas inlet EGR, as a result of the difference in intake/exhaust pressure and under the action of the compression spring 154.

When the speed and the engine load increase, the pressure at the exhaust is higher than the pressure at the intake and the force of the compression spring 154. The piston is thus pushed against the plug valve 5.

It is also possible to provide that the piston 151 is able to be optionally controlled by means of an electromagnetic coil or any other external control means.

Finally, it is possible to provide a closure cap 155 arranged opposite the piston 151 on the side opposing the side of the piston 151 designed to come into contact with the plug valve 5 to ensure the seal.

The closure cap 155 in this case has an opening 156, for example a central opening, permitting the inlet of the exhaust gases. This opening 156 may be connected to the exhaust gas manifold (not shown) by means of one or more pipes.

The closure cap 155 is also shaped to permit the passage of exhaust gases so as to apply a pressure to one surface of the piston 151, thus permitting a pressurization of the piston 151 to the pressure at the exhaust. This pressurization is shown schematically by the arrows EGR in FIG. 5. To achieve this, by way of example, at least one orifice 157 is provided on the closure cap 155, which is in fluidic communication with the opening 156 permitting the inlet of exhaust gases. The orifice(s) 157 is(are) according to the illustrated example, lateral orifices 157.

In conclusion, by means of the same control device 100 it is possible to block the passage of intake gases in a pipe 1 when the associated cylinder is deactivated so as to permit the supply of recirculated exhaust gases, or conversely to block the passage of exhaust gases in the pipe 1 when the cylinder is active, whilst ensuring the seal between the fresh air and the exhaust gases without requiring additional control of the sealing means 15.

Only one control of the deactivation means 5, more specifically the rotation of the plug valve 5, is required as the sealing means 15, which are controlled by the pressures at the intake and exhaust, comprise a piston 151, according to the embodiment described.

The elimination of a control system for the sealing means 15 makes it possible to reduce the costs and complexity of the control device 100. Moreover, this makes it possible to obtain an intake module M which is less bulky relative to the solutions of the prior art, providing a system for controlling the sealing means, such as a valve, arranged on the intake module M.

The invention claimed is:

1. A control device for a flow of intake gas and/or recirculated exhaust gases in a cylinder of an internal combustion engine, and for an intake module (M) comprising at least one pipe which is arranged so as to supply the cylinder with intake gas (F) and/or recirculated exhaust gases (EGR), the control device comprising:

a means for deactivating at least one pipe which is able to be controlled between a first position in which the pipe supplies the cylinder with the intake gases (F) and a second position in which the pipe supplies the cylinder with the recirculated exhaust gases (EGR), and a means for sealing configured to hermetically close an opening of the pipe for the inlet of exhaust gases, wherein the means for sealing is configured so as to be displaced as a result of the difference in pressure between the intake and the exhaust on both sides of the means for sealing, between:

a locked position of the means for deactivating in the first position when the pressure at the exhaust is higher than the pressure at the intake, and a position of release of the means for deactivating when the pressure at the exhaust is lower than the pressure at the intake.

2. A control device according to claim 1, in which the means for sealing comprises at least one piston.

3. A control device according to claim 2, in which the piston is configured so as to be displaced in translation along an axis (T) substantially perpendicular to the axis of rotation (R) of the means for deactivating.

4. A control device according to claim 2, in which the piston has a flattened portion over at least one surface.

5. A control device according to claim 2, in which the means for deactivating is rotatable about an axis (R) and capable of being arranged in a pipe of the intake module (M) such that the axis (R) is arranged substantially transversely relative to the pipe.

6. A control device according to claim 1, in which the means for deactivating is rotatable about an axis (R) and capable of being arranged in a pipe of the intake module (M) such that the axis (R) is arranged substantially transversely relative to the pipe.

7. A control device according to claim 6, in which the means for deactivating comprises a rotating plug valve of substantially cylindrical overall shape, comprising a lateral flank which is shaped so as to permit or block the circulation of intake gases (F) and/or recirculated exhaust gases (EGR) as a function of the angular position of the rotating plug valve.

8. A control device according to claim 7, in which the lateral flank is shaped so as to block the opening when the plug valve is in the first position and to block the passage cross section of the intake gases from the intake manifold when the plug valve is in the second position.

9. A control device according to claim 1, in which the means for sealing is configured so as to be in contact with the means for deactivating in the locked position and has a shape which is complementary to the shape of the means for deactivating in the region of the contact area.

10. A control device according to claim 1, comprising at least one means for returning which is arranged so as to urge the means for sealing into the position of release of the means for deactivating.

11. A control device according to claim 1, comprising a closure cap which is arranged opposite the means for sealing, which is shaped so as to permit the inlet of exhaust gases and which has at least one means for pressurizing to the pressure at the exhaust.

12. An air intake module for an internal combustion engine, the air intake module comprising at least one control device according to claim 1.

13. An air intake module of an internal combustion engine comprising at least two cylinders, the air intake module (M) comprising at least two control devices according to claim 1, each of the control devices being arranged so as to supply one of the cylinders, and the devices being configured so as to be controlled independently of one another.

* * * * *